United States Patent [19]

Futamase

[11] 4,026,179

[45] May 31, 1977

[54] ELECTRONIC MUSICAL INSTRUMENT

[75] Inventor: Tsuyoshi Futamase, Hamamatsu, Japan

[73] Assignee: Nippon Gakki Seizo Kabushiki Kaisha, Japan

[22] Filed: Sept. 22, 1975

[21] Appl. No.: 615,643

[30] Foreign Application Priority Data

Sept. 25, 1974 Japan ..... 49-110185

[52] U.S. Cl. ..... 84/1.24; 84/1.01; 84/1.26

[51] Int. Cl.[2] ..... G10H 1/02; G10F 1/00

[58] Field of Search ..... 84/1.01, 1.03, 1.13, 84/1.24, 1.26

[56] References Cited

UNITED STATES PATENTS 3,823,390 7/1974 Tomisawa et al. ..... 84/1.01

*Primary Examiner*—E. S. Jackmon

*Attorney, Agent, or Firm*—Ladas, Parry, Von Gehr, Goldsmith & Deschamps

[57] ABSTRACT

The electronic musical instrument according to the invention produces excellent tone color effect by changing filter characteristics discontinuously from the start of generation of a musical tone.

A plurality of filter characteristics each represented by a deflecting line consisting of straight lines (these filter characteristics being different from each other in coordinates at each point of deflection as well as inclination of each straight line) are stored in memory. These filter characteristics are sequentially read out with the lapse of time and level information of each harmonic constituting a musical tone is obtained by calculating a primary functional formula of the straight line region in which the read out filter characteristic belongs. The level of each harmonic is controlled in response to this level information.

In calculating the primary functional formula, one can select either "transferred formant" control in which a filter characteristic is substantially transferred by conducting calculation in accordance with a frequency corresponding to the degree of each harmonic or "fixed formant" control in which calculation is conducted in accordance with a frequency in which the fundamental frequency of the musical tone is included.

6 Claims, 7 Drawing Figures

ELECTRONIC MUSICAL INSTRUMENT

BACKGROUND OF THE INVENTION

This invention relates to an electronic musical instrument and, more particularly, to a digital type electronic musical instrument capable of producing an excellent tone color effect by changing filter characteristics discontinuously with the lapse of time from the start of generation of a musical tone.

For obtaining a musical tone which is as close a simulation of a natural musical tone as possible, it is considered disadvantageous to have the ratio of each harmonic remain unchanged with the lapse of time. It is accordingly desirable to have characteristics of a filter used in the electronic musical instrument suitably change with the lapse of time from the start of generation of the tone and thereby provide the tone color of the musical tone with subtle variations. In electronic musical instruments, however, variations in the filter characteristic have been realized only by sliding the cut-off frequency with a resultant parallel transfer of the filter characteristic. The variations in the tone color achieved by this arrangement are far from being satisfactory.

SUMMARY OF THE INVENTION

It is an object of the present invention to provide an electronic musical instrument capable of suitably changing ratios of harmonics constituting a musical tone and thereby producing a subtle change in the tone color.

It is another object of the invention to provide an electronic musical instrument capable of changing its filter characteristic discontinuously with the lapse of time and thereby increasing the latitude of tone color control of a musical tone and producing a tone color effect which provides a close simulation of a natural musical tone.

These and other objects and features of the invention will become apparent from the description made hereinbelow with reference to the accompanying drawings.

DESCRIPTION OF A PREFERRED EMBODIMENT

Figure 1:
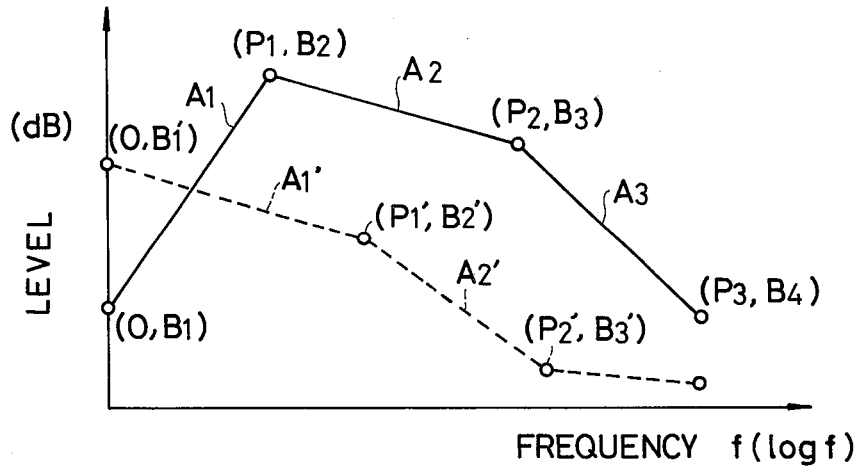
FIG. 1 is a graphic diagram for schematically explaining the operation principle of the present invention.

Referring first to FIG. 1, a principal feature of the present invention will be described. A digital type filter employed in the electronic musical instrument according to the invention has a characteristic of a deflecting line consisting of a plurality of straight lines as shown by the solid lines in FIG. 1. According to the invention, many kinds of filter characteristics, i.e. deflecting lines, can be obtained by varying co-ordinates $P_1$, $P_2$, $P_3$ . . . of X-distance (frequency $f$) and co-ordinates $B_1$, $B_2$, $B_3$ . . . of y-distance (level dB) of each point of deflection as well as inclinations $A_1$, $A_2$, $A_3$ . . . of each straight line. The frequency $f$ of the X-distance is expressed in a logarithmic scale so that each note name and its harmonics will directly correspond to its level. In a filter of such a characteristic, an amount of attenuation of a particular frequency (i.e. the level dB of the Y-distance) is obtained by carrying out the following functional formula concerning a primary function of a straight line region in which the frequency belongs:

$$Y = AX + B \tag{1}$$

If, for example, the frequency is a value between 0 and P1, level information expressed in a decibel scale can be obtained by substituting "$x$ = logarithmic information of the frequency" into an equation $Y = A_1x + B_1$. Alternatively expressed, level information of a particular frequency is obtained by calculating a primary functional formula of a straight line region in which the frequency belongs. Further, this level information can be variably adjusted by changing the filter characteristic discontinuously in the form of a deflecting line with lapse of time. As the filter characteristic changes, levels of corresponding frequencies (i.e. harmonics) change accordingly. The change in the filter characteristic can be obtained by coordinate information at the respective points of deflection and the inclinations of the respective straight lines.

Figure 2:
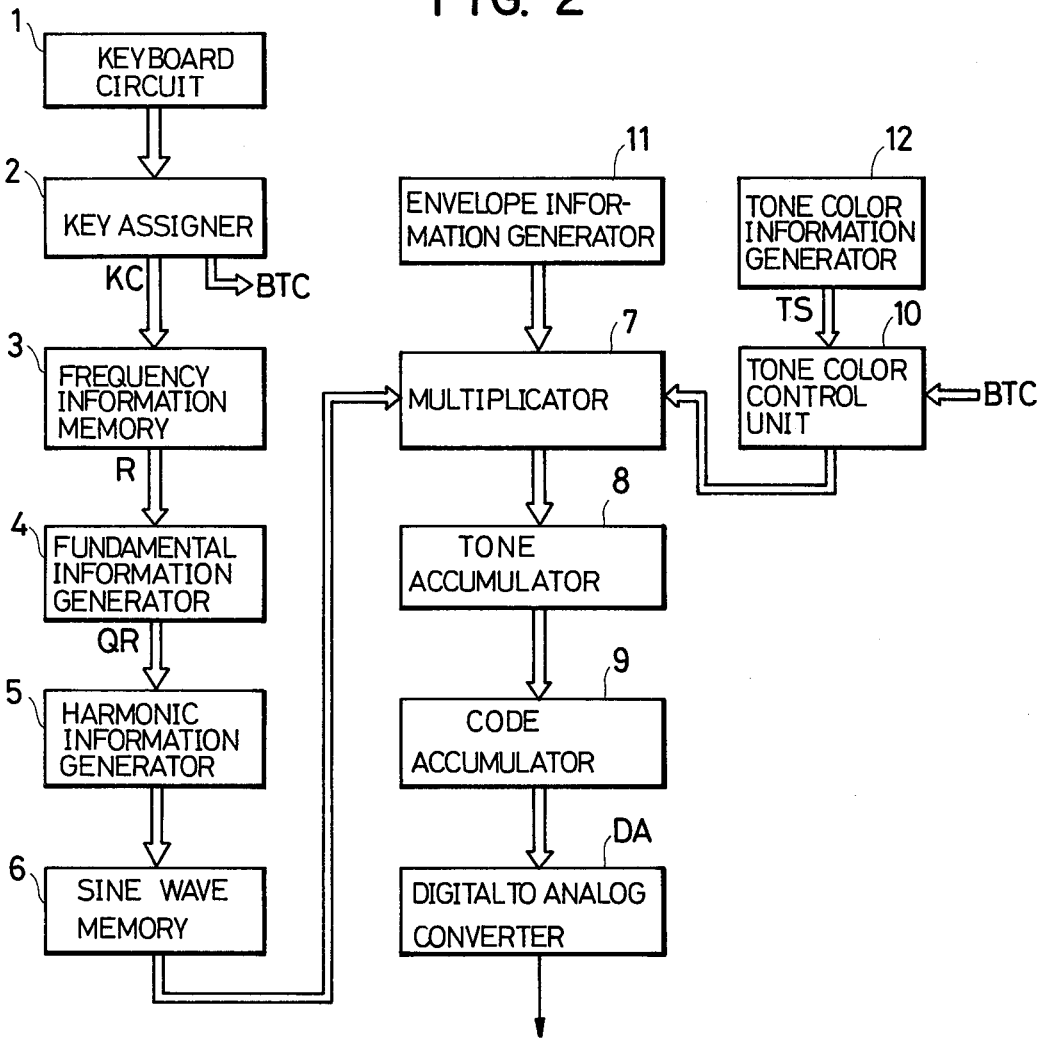
FIG. 2 is a block diagram showing a preferred embodiment of the electronic musical instrument according to the invention.

FIG. 2 illustrates one preferred embodiment of the electronic musical instrument according to the invention. Various information is processed digitally and finally converted to an audio signal through a digital-to-analog converter DA. The main feature of the present invention resides, as described above, in the provision of the tone color control unit 10 composed as a digital type filter. Before explaining the tone color control unit, the entire construction of the instrument will be briefly described.

Figure 4:
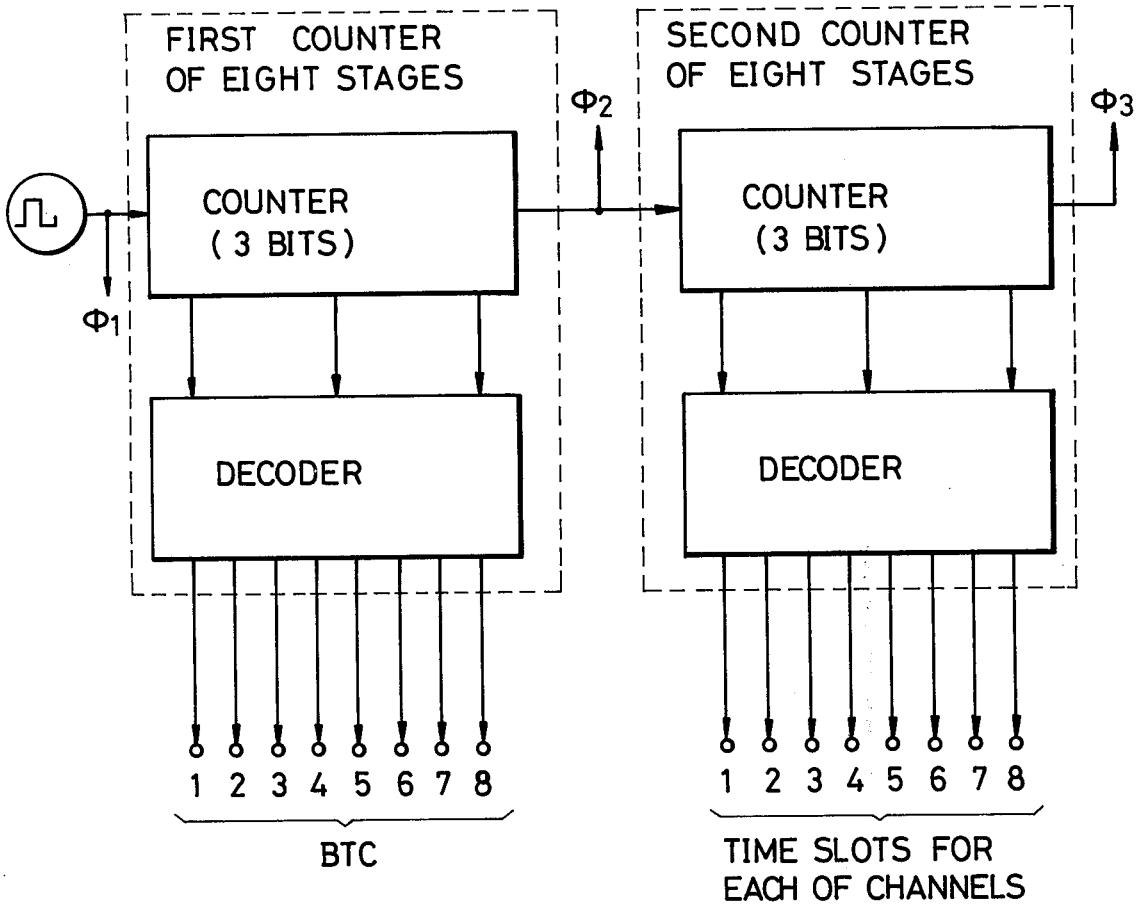
FIG. 4 is a detailed circuit diagram showing a circuit for producing clock pulses $\phi_2$, $\phi_3$, signal BTC and pulses appearing in time slots corresponding to the respective channels from clock pulse $\phi$.
Figure 5:
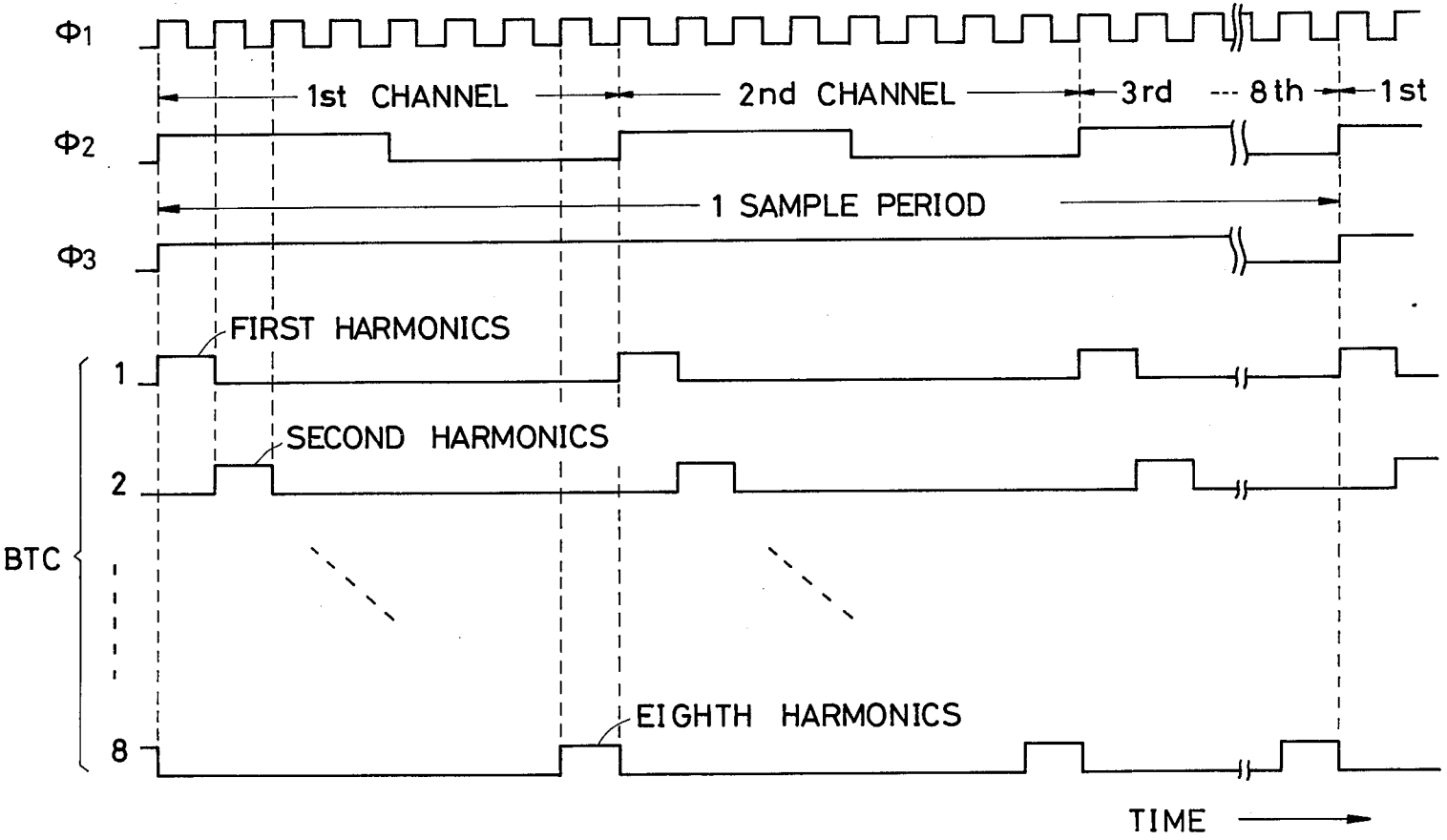
FIG. 5 is a timing chart showing relations between the signal BTC and the clock pulses $\phi_1$, $\phi_2$ and $\phi_3$.
Figure 7:
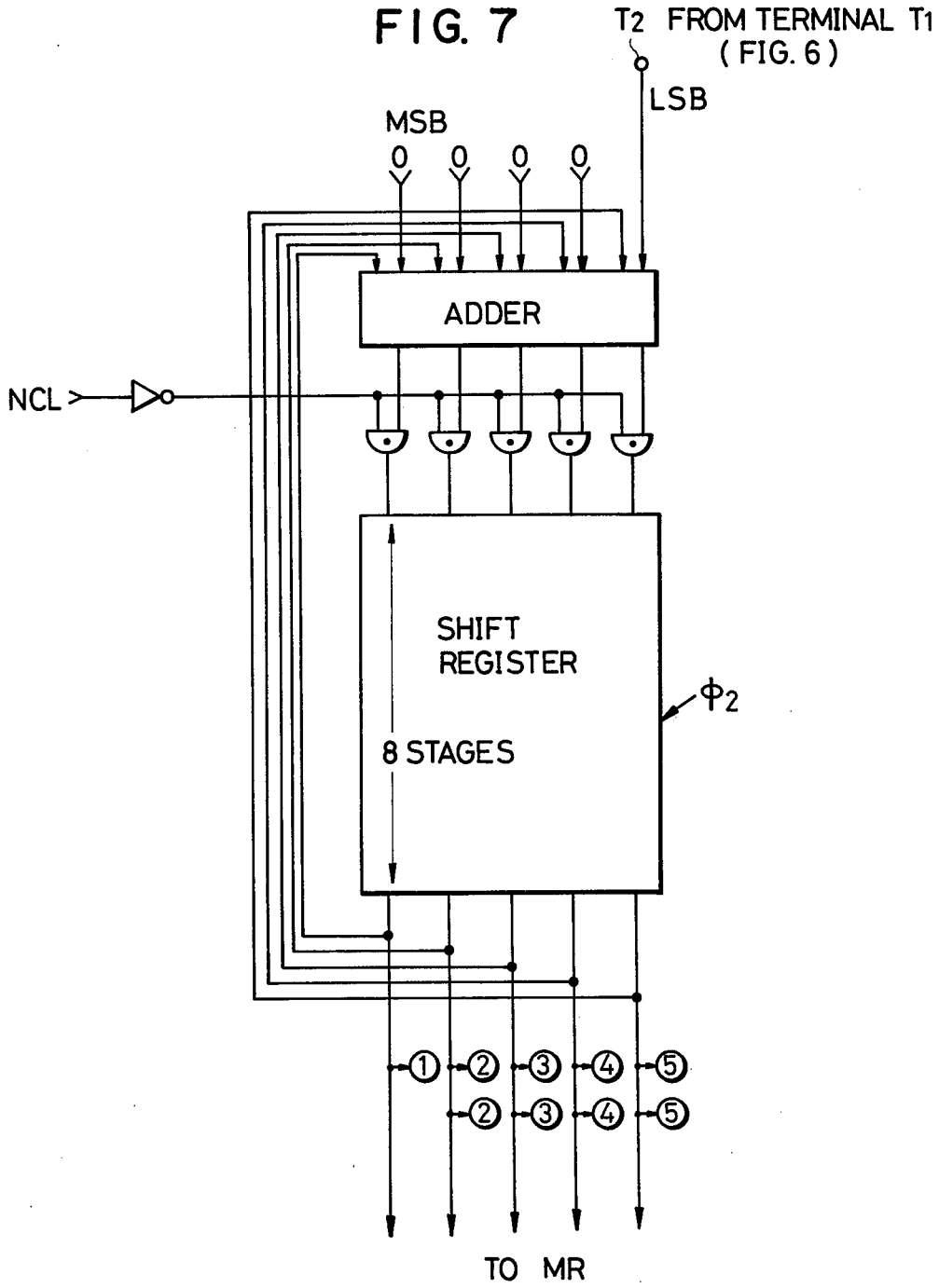

A key assigner 2 generates a key address code KC representing the key name of a depressed key in response to key-on information supplied from a keyboard circuit 1 and also generates various clock pulses or time-shared information used for controlling time-shared synchronized operations of various units of the instrument. Assume that the electronic musical instrument uses harmonics up to the eighth harmonic and that a maximum number of tones to be reproduced simultaneously is eight. Clock pulses are counted by a first counter of eight stages (FIG. 4) to form time sharing time slots for the respective harmonics and the frequency divided output of this counter is further counted by a second counter of eight stages (FIG. 4) to form time sharing time slots for the respective channels corresponding in number to the maximum number of tones to be reproduced simultaneously. The output of the first counter is hereinafter referred to as a degree-of-harmonic signal BTC. This signal BTC is utilized in a tone color control unit 10 as will be described later.

A frequency information memory 3 previously stores frequency information R which is a value proportionate to the frequency of each tone. Frequency information R corresponding to the depressed key is read out in response to contents of key address code KC. Fundamental information generator 4 cumulatively counts the frequency information R to produce fundamental information QR required for forming harmonic information. This causes the phase of the fundamental wave to be determined. The fundamental information QR is produced in a time sharing manner with respect to each of the eight tones. The output of the fundamental information generator 4 is applied to a harmonic information generator 5. In the harmonic information generator 5, while the fundamental information QR assumes a certain value, it is cumulatively counted at a rapid time sharing rate corresponding to the above described signal BTC, whereby address information NQR at each sample point used for reading out waveshape information of eight harmonics for each tone is sequentially produced. (The eight harmonics include the fundamental wave.) Thus the phase of each harmonic is determined.

Amplitude information of a sine wave at required sample points are read from a sine wave memory 6 in a time sharing manner in response to the address information NQR for the eight harmonics of each tone, whereby the amplitude information of the respective harmonics (including the fundamental wave) is obtained.

The above described construction is the same as the one described in U.S. Pat. No. 3,809,786 (5/1974) so that detailed description thereof is omitted. Construction and operation of the key assigner 2 are described in the copending U.S. patent application Ser. No. 448583 (now U.S. Pat. No. 3,903,755) of common assignment herewith.

In a multiplicator 7, this amplitude information is multiplied with envelope control information applied from an envelope information generator 11 for controlling the entire level of the musical tone and with harmonic level information applied from the tone color control unit 10 to produce musical tone amplitude information controlled in the tone color and the entire envelope in a time sharing manner.

This musical tone amplitude information is applied to a tone accumulator 8 where the amplitudes of the fundamental wave up to the eighth (*n*-th) harmonic are added together for each tone and amplitude information of the musical tone is thereby formed. Further, in a code accumulator 9, amplitude information of a plurality of tones is added together by each keyboard and thereafter is provided as an analog musical signal through a digital-to-analog converter DA. Since the amplitude information read from the sine wave memory 6 is expressed in a linear scale, the construction of the multiplicator 7 may be simplified by expressing the envelope control information and the harmonic level information in a decibel scale. Further, it is to be noted that operations of the component parts of the instrument are synchronized with each other with respect to the same degree of harmonic in the same channel.

A tone color information generator 12 generates tone color information TS for achieving a tone color selected by the performer by operation of a tone lever (not shown). This tone color information TS consists of information for controlling the levels of the respective harmonics and thereby determines a tone color. The tone color control unit 10 performs the above described filter function in a digital fashion, the produced filter characteristic changing discontinuously with the lapse of time. The tone color information TS is modulated in accordance with the filter characteristic of the tone color control unit 10 at a given time point and the differently modulated tone color information is sequentially supplied to a multiplicator 7 with the lapse of time as harmonic level information. In the multiplicator 7, the level of each corresponding frequency is controlled in response to the level information, whereby the filter function is virtually performed.

Figure 3:
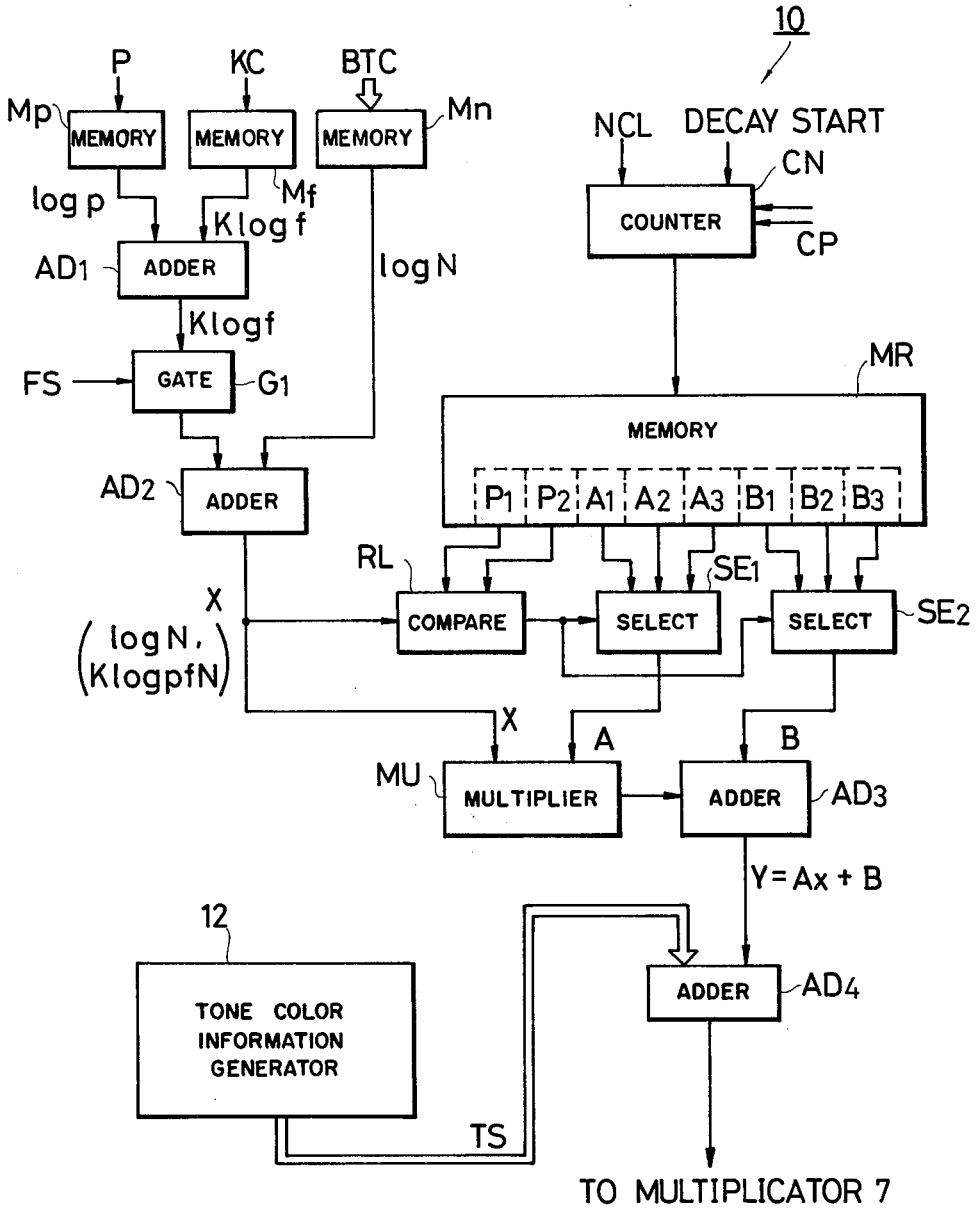
FIG. 3 is a block diagram showing a tone color control unit of FIG. 2 in detail.

FIG. 3 shows an example of the tone color control unit 10. A plurality of different filter characteristics (e.g. 32 kinds) each being expressed in the form of a deflecting line consisting of three straight lines respectively having inclinations $A_1$, $A_2$ and $A_3$ are stored in a memory MR. Since the straight portion of the filter characteristic can be obtained by calculation, contents actually stored in the memory MR are eight kinds of information, i.e., the inclinations $A_1$, $A_2$ and $A_3$, initial value information $B_1$, $B_2$ and $B_3$ of the Y-distance at the respective points of deflection and logarithmically expressed frequency information $P_1$ and $P_2$ of the X-distance at the respective points of deflection, the information $P_1$ and $P_2$ being required for distinguishing the straight line region in which the frequency belongs. Thus, 32 kinds of filter characteristics each consisting of eight kinds of information are stored in the memory MR. If each information consists of 8 bits, the memory MR will have a capacity of $32 \times 8 \times 8$ bits. These characteristics stored in the memory MR are read therefrom in response to 32 corresponding address inputs. More specifically, when a certain address is applied to the memory MR, 8 kinds of information $A_1$ through $P_2$ of a corresponding filter characteristic is read from the memory MR.

The addresses for the memory MR are formed by a counter CN. The counter CN has its counting contents cleared and starts counting upon receipt of a new claim signal NCL which represents start of depression of a certain key and is supplied from the operation logical circuit 2. To the counter CN is applied a suitable clock pulse CP in accordance with which counting operation of the counter CN proceeds. As the counting proceeds, the read out filter characteristic changes with the lapse of time. The counting pulse CP applied to the counter CN should preferably be those for attack and decay purposes. Namely, upon application of each of 16 attack pulses, each of 16 kinds of filter characteristics is read out one by one and, upon application of 16 decay pulses, each of the remaining 16 filter characteristics is sequentially read out. The attack counting pulses are used for forming addresses for reading out an attack envelope consisting of 16 sample points, whereas the decay counting pulses are used for forming addresses for reading out a decay envelope. Accordingly, change in the tone color which is discontinuous in the decay period as compared with the attack period is produced. If one desires to change the order of the discontinuous change in the tone color (i.e., the mode of the tone color change), a plurality of memories similar in construction to the memory MR (but different in their contents of storage) may be provided in addition to the memory MR and the address signals from the counter CN may be selectively distributed through a selection circuit (not shown) to desired ones of these memories for reading out the contents thereof.

The calculation of the equation (1) is performed on the basis of information read from the memory MR. The logarithmic information X of the frequency which is used as a variable in the above equation is obtained in the following manner: If, for example, eight octaves from $C_2$ to $C_{10}$ are used in the present embodiment, one octave is divided by 12 and the notes of the eight octaves are arranged so as to correspond to numerical values of 0–96. These numerical values correspond to a logarithmic indication "K log $f$" where K represents a constant and $f$ represents frequency of each note. A memory Mf previously stores information of each note expressed in a logarithmic scale. Logarithmic information corresponding to the frequency of the note of a depressed key is read from the memory M$f$ in response to the key address code KC.

A memory M$p$ is provided for producing pitch information (feet information) expressed in a logarithmic scale and corresponding to a pitch adjustment (feet adjustment) signal P which can be set at one of a plurality of stages (e.g. four stages). The pitch information read from the memory Mp is applied to an adder $AD_1$ where it is multiplied with the logarithmic information read from the memories M$f$. Logarithmically expressed information K log P$f$ of the fundamental frequency Pf corresponding to the note of the depressed key is obtained in this manner. This information K log P$f$ is 0 for the note $C_2$, 1 for the note $C_2$sharp . . . . .12 for the note $C_3$ . . . .

A memory M$n$ previously stores logarithmic information corresponding to degreees of harmonics. Logarithmic information log N of the frequencies of the first through the eighth harmonics is sequentially read from the memory Mn in response to the time-shared degree-of-harmonic signal BTC supplied from the key assigner 2. This information log N is, for example, 0 for the first harmonic (i.e. the fundamental), 12 for the second harmonic and 24 for the fourth harmonic.

If one desires to control ratios of harmonics only, the information log N read from the memory Mn only is used in calculation. This enables the relation between the harmonics only to be controlled with a result that information of a harmonic of the same degree throughout all notes is produced with the same level as long as the information $A_1$–$P_2$ read from the memory MR remains unchanged. Alternatively stated, the variable of the X-distance in the filter characteristic shown in FIG. 1 in this case is a frequency corresponding to the degree of a harmonic and the filter characteristic substantially is transferred relative to an absolute frequency in which the fundamental frequency is included. Such control is hereinafter called "transferred formant". If the fundamental frequency is taken into consideration in obtaining level information of the harmonics, the information K log Pf of the fundamental is added to the information log N of the harmonic in an adder AD2 to produce logarithmic information K log P$f$N corresponding to each harmonic frequency of the fundamental frequency. This information K log PfN is used for calculation as the variable X. According to this type of control, the levels of the harmonics of the same degree of the respective notes change if the fundamental frequency changes even though the information $A_1$–$P_2$ remains unchanged. Such control is hereinafter called "fixed formant". Selection between the "transferred formant" and "fixed formant" is made by a gate circuit $G_1$. More specifically, if a formant selection signal FS has selected "transferred formant", the gate circuit $G_1$ is closed and the information log N only is passed through the adder $AD_2$ and used as the variable X. If the formant selection signal FS has selected "fixed formant", the information K log P$f$ is applied to the adder $AD_2$ through the gate circuit $G_1$ and the information K log P$f$N which is a result of addition conducted in the adder $AD_2$ is used as the variable X. "Transferred formant" is used in a case where the tone color to be finally obtained from the electronic musical instrument should be uniform regardless of difference in the note, i.e., the relative relations between the levels of the respective harmonics are the same regardless of difference in the note.

The logarithmic frequency information X which is the output of the adder $AD_2$ is applied to a region comparison circuit RL and also to a multiplicator MU. The region comparison circuit RL compares the information $P_1$, $P_2$ of the X-distance at a point of deflection read from the memory MR with the information X and detects a straight line region in the filter characteristic in which the frequency represented by the information X belongs. A selection signal is supplied from the circuit RL to selection circuits $SE_1$ and $SE_2$ in accordance with a result of detection in the circuit RL. In the selection circuits $SE_1$ and $SE_2$, inclination A($A_1$, $A_2$, $A_3$) of the straight line region in which the frequency belongs and initial value level information B ($B_1$, $B_2$, $B_3$) are selected in accordance with the selection signal, the selected information being applied to the multiplicator MU and an adder $AD_3$. The multiplicator MU and the adder $AD_3$ carry out the calculation of the equation (1). First, in the multiplicator MU, the information X corresponding to the frequency is multiplied with the selected inclination A. Then the result of multiplication AX and the selected initial value B are added together to produce level information $Y = AX + B$. The above calculation is conducted in a time-sharing manner with respect to each of the eight tones and by each harmonic frequency, level information Y of each harmonic being supplied in time sharing to an adder $AD_4$. The adder $AD_4$ receives also tone color information TS which is harmonic level information supplied from the tone color information generator 12 for realizing a desired tone color. The two level informations are added (substantially multiplied) together in the adder $AD_4$ and harmonic level information for finally determining the tone color is supplied from the adder $AD_4$ to the multiplicator 7. The adders (except the adder $AD_3$) employed in the present embodiment substantially carry out multiplication so that the multiplicator may be substituted by an adder since the information is expressed in a logarithmic scale.

An example of a case where the tone color changes discontinuously with the lapse of time will now be described.

Assume that information of a characteristic as shown by the solid lines in FIG. 1 is read from the memory MR at a first step of the counter CN. If logarithmic information X of a particular frequency is $P_1$ and $P_2$, level information obtained as a result of calculation is $Y = A_2X + B_2$. Assuming further that information of a characteristic as shown by the broken line in FIG. 1 is read from the memory MR at a next step of the counter CN, level information obtained is $Y = A_1'X + B_1'$. Subsequently, the filter characteristic changes discontinuously and as desired with the lapse of time (i.e. counting of the counter CN). Harmonics of each musical tone are controlled in accordance with harmonic level information of the musical tone obtained in the foregoing manner and sufficient change in the tone color is achieved in accordance with the filter characteristic which varies as desired.

The straight lines which constitute the deflecting line of the filter characteristic are not limited to three but any desired number of straight lines may be used. The mode of tone color change can be changed as desired by rewriting contents of storage in the memory MR. Further, the present invention is not limited to the above described electronic musical instrument but any type of electronic musical instrument comprising a digital type filter equivalent to the tone color control unit 10 falls within the scope of the invention.

Figure 6:
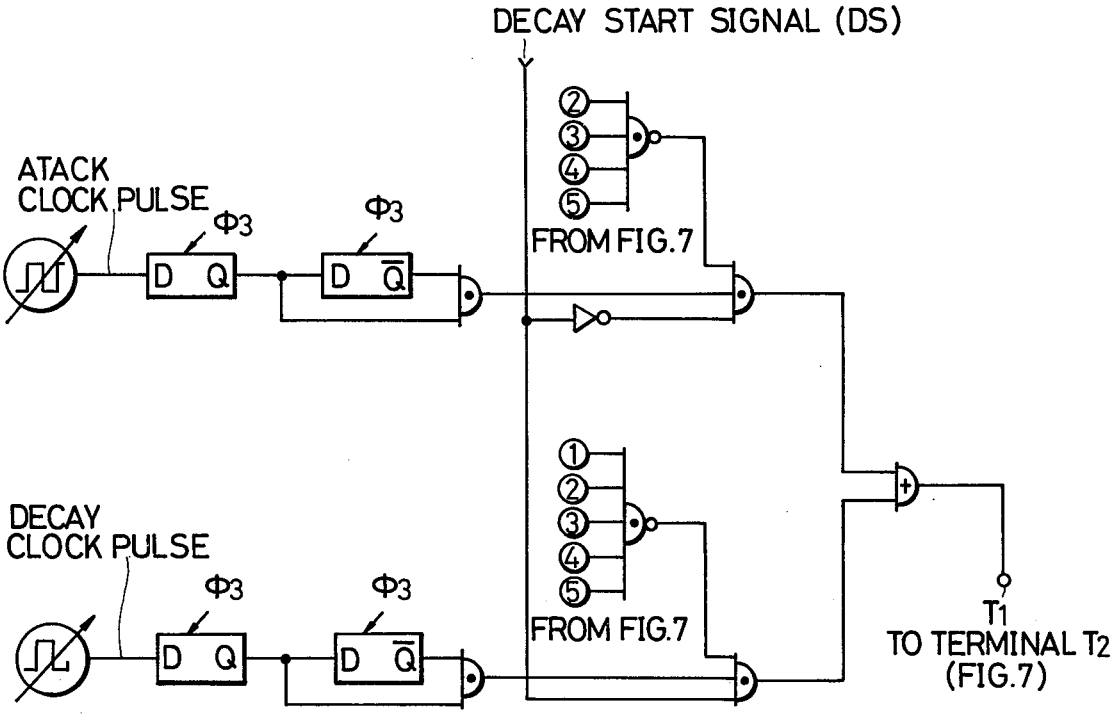
FIGS. 6 and 7 are circuit diagram showing construction of the counter CN of FIG. 3 in detail.

The circuit for generating the signal BTC and the time slot pulses for the respective channels and the counter CN can be constructed of any known circuit a few examples of which are illustrated in FIGS. 4–7. In FIGS. 3 and 6 the decay start signal is the same signal as the output of the release register described in the aforesaid U.S. patent application Ser. No. 448583.

What is claimed is:

1. An electronic musical instrument in which amplitude information for the fundamental and harmonic components of a musical tone waveshape is multiplied with tone color information for controlling the respective levels of said fundamental and harmonic components, wherein a tone color control unit is provided for modulating said tone color information before the multiplication of said amplitude information therewith takes place, said tone color control unit comprising:

memory means having information stored therein consisting of data defining different respective attenuation level vs. frequency characteristics of a plurality of filters;

read out means for reading out from said memory means, characteristic-by-characteristic, the stored data information defining each filter characteristic; and calculating means for calculating attenuation level information on the basis of the read out data information, said calculating means including an adder for adding said attenuation level information to said tone color information for the modulation thereof.

2. An electronic musical instrument as defined in claim 1 in which said stored data for each information filter characteristic is represented by a deflecting line consisting of a plurality of straight lines in a coordinate system in which the X-distance represents a frequency and the Y-distance represents amount of attenuation, i.e. level, the respective straight lines consisting of data representing inclinations $A_1, A_2 \ldots A_n$, coordinates in the X-distance $P_1, P_2 \ldots$ Pn each representing a logarithmically expressed frequency value and coordinates in the Y-distance $B_1, B_2 \ldots$ Bn each representing a level value (dB) at respective points of deflection.

3. An electronic musical instrument as defined in claim 2 in which said read out means sequentially read out information of different straight lines with the lapse of time.

4. An electronic musical instrument as defined in claim 2 in which said calculating means comprise:

means for generating frequency information X;

a straight line region comparison circuit for detecting which straight line region in the read out straight line information the generated frequency information X belongs to;

selecting means for selecting, in response to the output of said straight line region comparison circuit, the inclination A of the straight line region to which the frequency information belongs and the level value B thereof; and a calculation circuit for carrying out the calculation $Y = AX + B$ where Y is said attenuation level information.

5. An electronic musical instrument as defined in claim 4 in which said frequency information is log N.

6. An electronic musical instrument as defined in claim 4 in which said frequency information is K log PfN where P represents feet, $f$ the fundamental frequency of said musical tone waveshape and N the degree of harmonic of said musical tone waveshape.

* * * * *